US012285700B2

(12) United States Patent
Smock et al.

(10) Patent No.: US 12,285,700 B2
(45) Date of Patent: Apr. 29, 2025

(54) RIDE ON TOY VEHICLE

(71) Applicant: Honda Motor Co., Ltd., Tokyo (JP)

(72) Inventors: Randall Smock, Redondo Beach, CA (US); Andrew Malcolm Foster, Ladera Ranch, CA (US); Rudolph Carruolo, Gardena, CA (US); Brian P Furutani, Gardena, CA (US); Jackie P Porchay, Torrance, CA (US); Robert F Curiel, Corona, CA (US); Terry L Gasparovic, Torrance, CA (US); Robert Antonio Rangel, Huntington Beach, CA (US); Matthew R Cardon, Anaheim, CA (US)

(73) Assignee: Honda Motor Co., Ltd., Tokyo (JP)

( * ) Notice: Subject to any disclaimer, the term of this patent is extended or adjusted under 35 U.S.C. 154(b) by 691 days.

(21) Appl. No.: 17/693,179

(22) Filed: Mar. 11, 2022

(65) Prior Publication Data

US 2023/0158415 A1 May 25, 2023

Related U.S. Application Data

(60) Provisional application No. 63/282,855, filed on Nov. 24, 2021.

(51) Int. Cl.

| | |
|---|---|
| ***A63H 17/38*** | (2006.01) |
| ***A63H 17/26*** | (2006.01) |
| ***A63H 29/22*** | (2006.01) |

(52) U.S. Cl.

CPC ..... *A63H 17/38* (2013.01); *A63H 17/262* (2013.01); *A63H 29/22* (2013.01)

(58) Field of Classification Search

CPC ..... A63H 17/38; A63H 29/22
USPC ..... 446/460, 461, 462, 463
See application file for complete search history.

(56) References Cited

U.S. PATENT DOCUMENTS

| | | | | | |
|---|---|---|---|---|---|
| 3,566,988 | A | * | 3/1971 | Wise | A01D 34/008 446/442 |
| 5,439,071 | A | * | 8/1995 | Rodriguez-Ferre | B60K 26/00 340/5.31 |
| 5,816,352 | A | * | 10/1998 | Hacker | A63H 30/04 180/430 |
| 5,845,724 | A | * | 12/1998 | Barrett | B62B 3/001 180/321 |
| 5,859,509 | A | * | 1/1999 | Bienz | H02P 7/285 318/287 |

(Continued)

FOREIGN PATENT DOCUMENTS

WO 2015041864 A1 3/2015

*Primary Examiner* — Joseph B Baldori

(74) *Attorney, Agent, or Firm* — Aaron Fong; American Honda Motor Co., Inc.

(57) ABSTRACT

A ride on vehicle for a child that includes a vehicle body supported on a plurality of wheels, and electric motor powered by a battery and operatively coupled to at least one drive wheel of the plurality of wheels to propel the vehicle. The vehicle also includes a rod structure arranged at a rear of the vehicle and coupled to the vehicle body, and a lever adapted to be displaced between a first position and a second position to selectively enable or disable a propelling of the vehicle through the electric motor. In the first position of the lever, the vehicle is configured to be propelled by operating the electric motor. In the second position of the lever, the propelling of the vehicle through the electric motor is disabled.

17 Claims, 5 Drawing Sheets

(56) References Cited

U.S. PATENT DOCUMENTS

| | | | | |
|---|---|---|---|---|
| 6,349,786 | B1 * | 2/2002 | Gift | B60K 28/10 180/271 |
| 6,464,029 | B2 * | 10/2002 | Gu | B62K 9/00 180/65.6 |
| 6,771,034 | B2 * | 8/2004 | Reile | B60L 3/04 446/457 |
| 7,243,746 | B1 * | 7/2007 | Vasant | B62D 11/04 180/21 |
| 7,374,228 | B2 | 5/2008 | Whale | |
| 7,513,324 | B2 | 4/2009 | Bergum et al. | |
| 7,794,303 | B2 | 9/2010 | Cassidy | |
| 8,366,135 | B2 | 2/2013 | Asbach et al. | |
| 9,643,606 | B2 | 5/2017 | Remes | |
| 10,245,520 | B2 | 4/2019 | Young et al. | |
| 10,394,233 | B2 | 8/2019 | Young et al. | |
| 10,471,365 | B2 | 11/2019 | Rendell | |
| 10,786,407 | B2 | 9/2020 | Ellis | |
| 11,077,384 | B2 * | 8/2021 | Talios | A63H 33/008 |
| 11,097,614 | B2 * | 8/2021 | Placer | B60L 1/00 |
| 11,787,472 | B2 * | 10/2023 | Zemskov | B60L 50/60 180/6.24 |
| 2005/0202752 | A1 * | 9/2005 | Bryner | B62J 45/20 446/465 |
| 2006/0175101 | A1 * | 8/2006 | Drosendahl | H02K 11/25 180/65.1 |
| 2010/0059968 | A1 * | 3/2010 | Asbach | B60D 1/06 280/220 |
| 2011/0012548 | A1 * | 1/2011 | Wilcox | B60L 3/04 180/65.8 |
| 2019/0054232 | A1 | 2/2019 | Cashin et al. | |
| 2021/0046975 | A1 | 2/2021 | Zemskov et al. | |
| 2021/0146038 | A1 | 5/2021 | Johnson et al. | |

* cited by examiner

RIDE ON TOY VEHICLE

CROSS-REFERENCE TO RELATED DISCLOSURES

This disclosure claims the benefit of U.S. Provisional Patent Application, Ser. No. 63/282,855 entitled "RIDE-ON ELECTRIC VEHICLE", filed on Nov. 24, 2021; the entirety of the above-noted application(s) is incorporated by reference herein.

BACKGROUND

The disclosed subject matter relates generally to a ride on vehicle for a child. More particularly, the disclosed subject matter relates to a ride on electric toy vehicle that enables an infirmed child to enjoy the experience of driving.

Some toys allow a child to maneuver their own personal trucks, vehicles, and ATVs. These toys may be miniaturized and include a six (6) or twelve (12)-volt battery which supplies power to an electric motor. A steering wheel may allow the child to move the toy as they actuate a pedal with their foot. Unfortunately, not all are able to enjoy the use of these toys. For example, in a hospital, these toys are not typically found as children who are sick require special medical equipment or machines. The present disclosure provides a ride-on vehicle that overcomes these challenges as well as provide other benefits.

SUMMARY

In accordance with one embodiment of the present disclosure, a ride on vehicle for a child is provided. The ride on vehicle includes a vehicle body supported on a plurality of wheels, and an electric motor powered by a battery and operatively coupled to at least one drive wheel of the plurality of wheels to propel the vehicle. The vehicle also includes a rod structure arranged at a rear of the vehicle and coupled to the vehicle body. The rod structure is adapted to hold medical equipment. The vehicle further includes a lever adapted to be displaced between a first position and a second position to selectively enable or disable a propelling of the vehicle through the electric motor. In the first position of the lever, the vehicle is configured to be propelled by operating the electric motor. In the second position, the propelling of the vehicle through the electric motor is disabled.

In accordance with another embodiment of the present disclosure, a ride on vehicle for a child is provided. The ride on vehicle includes a vehicle body supported on a plurality of wheels, and an electric motor powered by a battery and operatively coupled to at least one drive wheel of the plurality of wheels to propel the vehicle. The vehicle also includes a rod structure arranged at a rear of the vehicle and coupled to the vehicle body. The rod structure is adapted to hold medical equipment. The vehicle further includes a lever adapted to be displaced between a first position and a second position to selectively enable or disable a propelling of the vehicle through the electric motor. Moreover, the vehicle also includes a steering lock adapted to be moved to a locked position and an unlock position to selectively disable or enable a steering of at least one steering wheel of the plurality of wheels in response to a rotation of a steering handle.

In accordance with yet a further embodiment of the present disclosure, a ride on vehicle for a child is provided. The ride on vehicle includes a vehicle body supported on a plurality of wheels, and an electric motor powered by a battery and operatively coupled to at least one drive wheel of the plurality of wheels to propel the vehicle. The vehicle also includes a rod structure arranged at a rear of the vehicle and coupled to the vehicle body. The rod structure is adapted to hold medical equipment. The vehicle further includes a lever adapted to be displaced between a first position and a second position to selectively enable or disable a propelling of the vehicle through the electric motor. Moreover, the vehicle also includes a steering lock adapted to be moved to a locked position and an unlock position to selectively disable or enable a steering of at least one steering wheel of the plurality of wheels in response to a rotation of a steering handle. Furthermore, the vehicle includes a speed control knob adapted to be displaced between a plurality of positions to select a maximum speed of the vehicle.

BRIEF DESCRIPTION OF THE DRAWINGS

Certain embodiments of the present disclosure will be better understood from the following description taken in conjunction with the accompanying drawings in which.

DETAILED DESCRIPTION OF EXEMPLARY EMBODIMENTS

A few inventive aspects of the disclosed embodiments are explained in detail below with reference to the various figures. Exemplary embodiments are described to illustrate the disclosed subject matter, not to limit its scope, which is defined by the claims. Those of ordinary skill in the art will recognize a number of equivalent variations of the various features provided in the description that follows. Embodiments are hereinafter described in detail in connection with the views and examples of FIGS. 1-8, wherein like numbers indicate the same or corresponding elements throughout the views.

Figure 1:
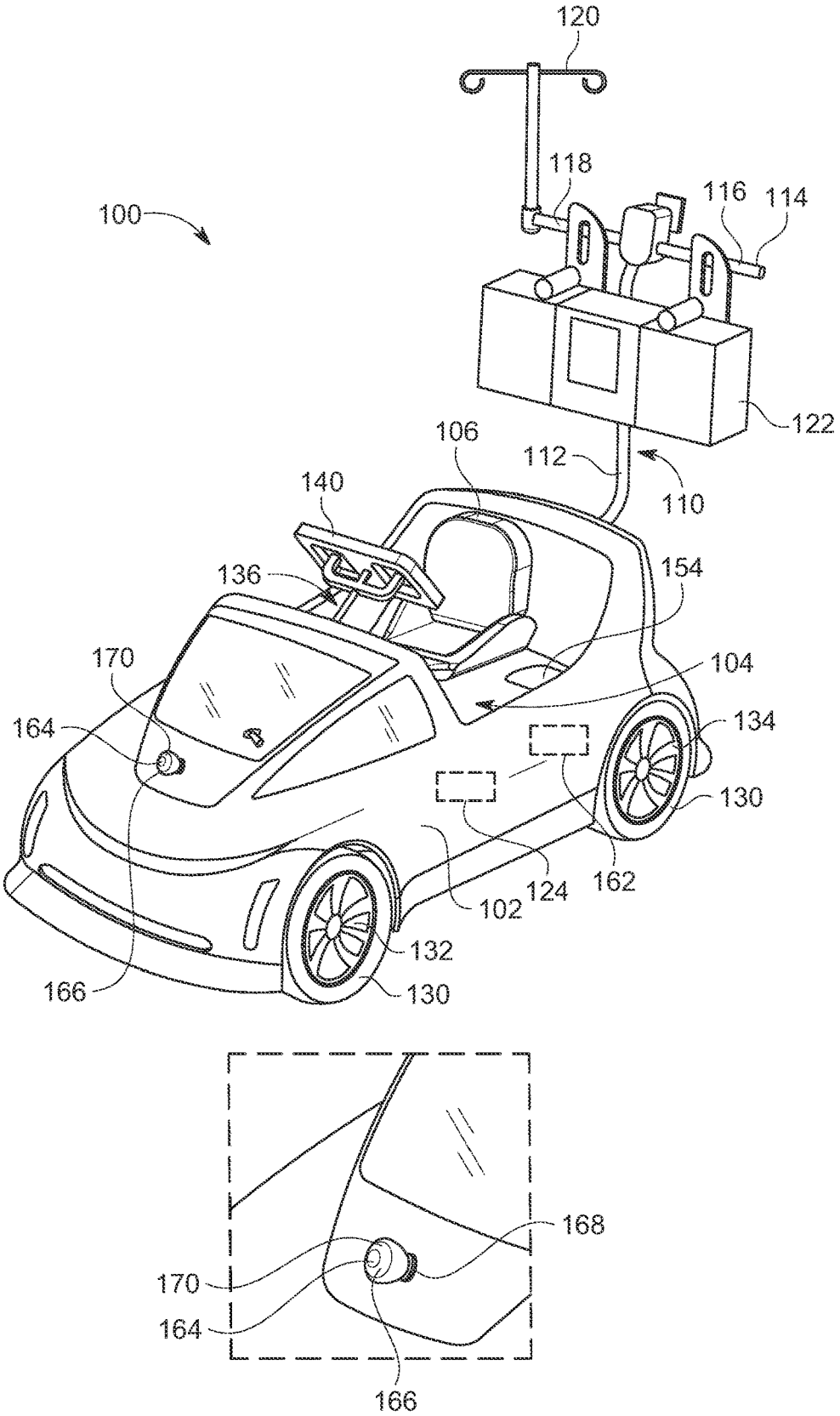
FIG. 1 is a front perspective view of a ride on vehicle, in accordance with one embodiment of the present disclosure.

FIG. 1 illustrates a perspective view of a ride on vehicle (hereinafter referred to as a vehicle), indicated generally at 100, in accordance with one embodiment of the present disclosure. The vehicle 100 allows a child who has certain conditions to enjoy the pleasures of riding and driving.

While the vehicle 100 is shown as a car, it may be appreciated that other mobility devices, for example, a truck, ATV, scooter, bike, and the like may be encompassed within the present disclosure. The vehicle 100 is powered by a battery 124 for propelling over a path. The battery 124 provides power to an electric motor 162 of the vehicle 100 which in turn rotates at least one wheel of the vehicle 100.

Figure 2:
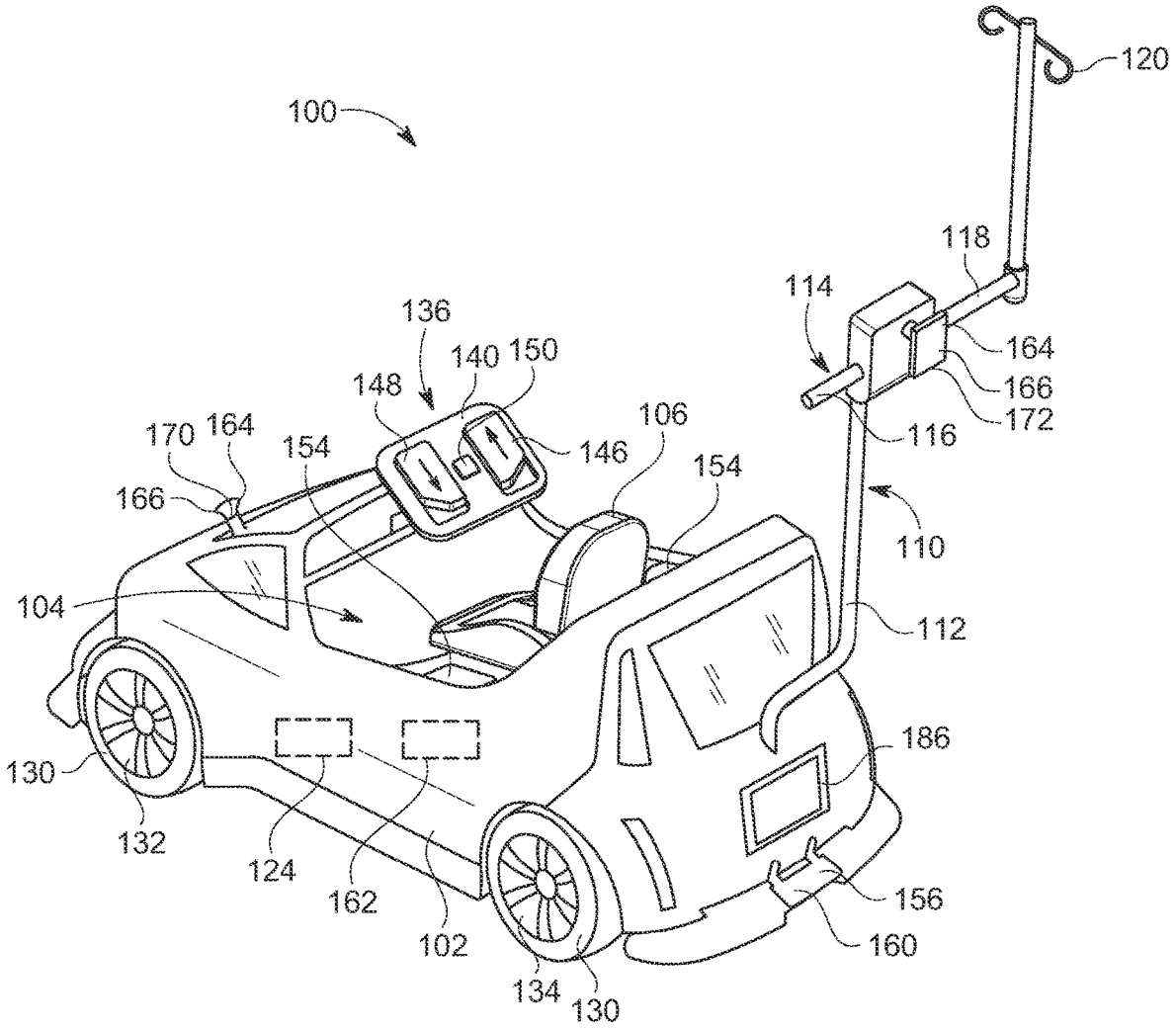
FIG. 2 is rear perspective view of the ride on vehicle of FIG. 1, in accordance with one embodiment of the present disclosure.

As shown in FIG. 1 and FIG. 2, the vehicle 100 includes a body 102 defining a passenger compartment 104 with at least one seat 106 that is sized to accommodate at least one child, including a child driver. The seat 106 may be integral with or otherwise mounted on the body 102 and may have any suitable configuration known in the art. The body 102 typically is formed from molded plastic and may be integrally formed or formed from a plurality of parts that are secured together by screws, clips or other suitable fasteners. Alternatively, the body 102 may be made of some other suitable material including metal, wood, or composite structure having suitable strength to accommodate and support the weight of at least one child. The body 102 may include an underlying frame on which a chassis is mounted.

Further, the vehicle 100 includes a rod structure 110 arranged at a rear of the vehicle 100 and engaged to a rear end of the body 102. In an embodiment, the rod structure 110 may be a detachable rod structure 110 that is removably engaged with the body 102 by a clasping mechanism, fasteners, or any other suitable mechanisms known in the art. As shown, the rod structure 110 may include a first rod 112 having a lower end engaged to the body 102 and extending in a vertically upward direction from the body 102. Also, the rod structure 110 includes a second rod (i.e., handlebar 114) extending in a substantially horizontal direction from an upper end of the first rod 112. As shown, the handlebar 114 extends on both sides of the first rod 112, and defines two handle portions 116, 118 to be held by a caretaker of the child sitting inside the vehicle 100. Moreover, the rod structure 110 may include at least one hook structure 120 to enable a hanging of at least a medical equipment, for example, one bottle or pouch carrying intravenous fluids, or any other article on the rod structure 110. Further, a protective box 122 housing the medical hardware may be mounted on the rod structure 110, for example, on the handlebar 114. It may be envisioned that the power required for operating the medical hardware may be provided by the battery 124 of the vehicle 100.

The vehicle 100 also includes a plurality of wheels 130 supporting the body 102 to facilitate am movement of the vehicle 100 on a surface. In the illustrated embodiment, the vehicle 100 includes four wheels 130, with front wheels 132 forming steerable wheels, and rear wheels 134 forming drive wheels. It should be understood that the number of wheels 130 on the vehicle 100 may vary from two wheels to four, six or more wheels, although children's ride-on vehicles typically include at least three wheels for stability. It is within the scope of the disclosure that either or both of front wheels 132 or rear wheels 134 are driven and steerable. Similarly, one front wheel 132 and one rear wheel 134 may be driven and/or steerable, or the vehicle 100 may include one or more driven or steerable wheels underneath its body 102 that are generally hidden by the body 102 of the vehicle 100.

Figure 3:
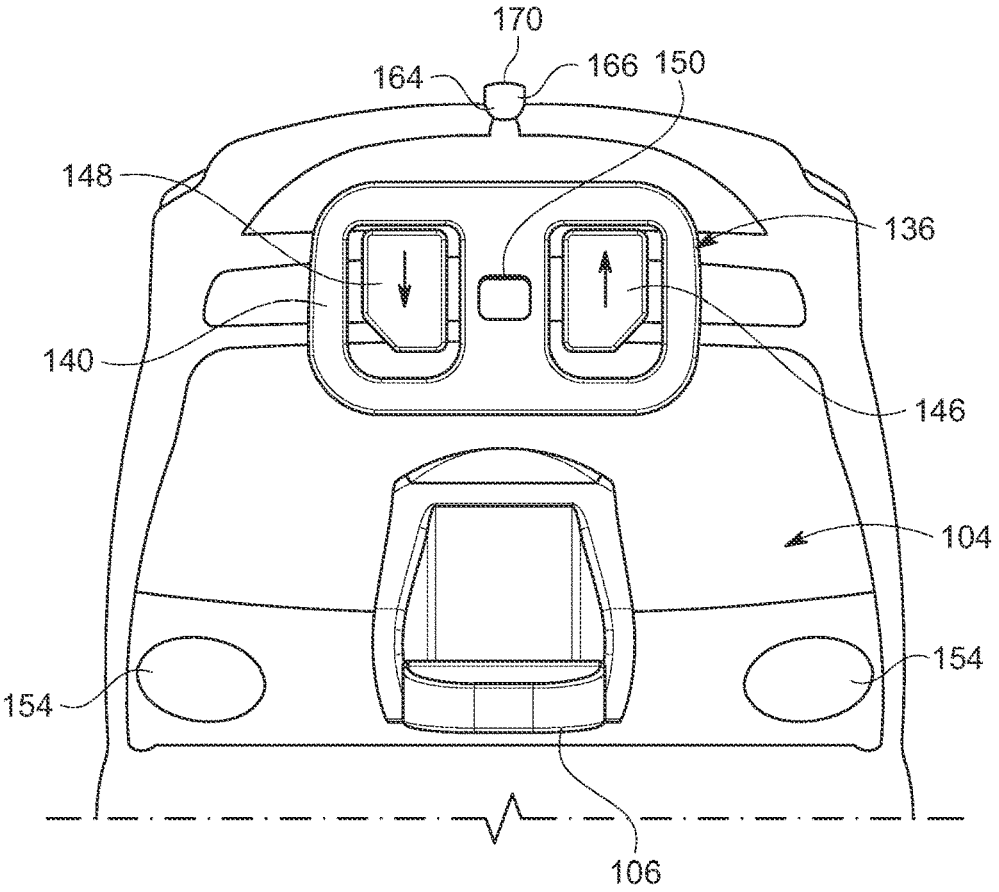
FIG. 3 is top perspective view of a passenger compartment of the ride on vehicle of FIG. 1, in accordance with one embodiment of the present disclosure.
Figure 4:
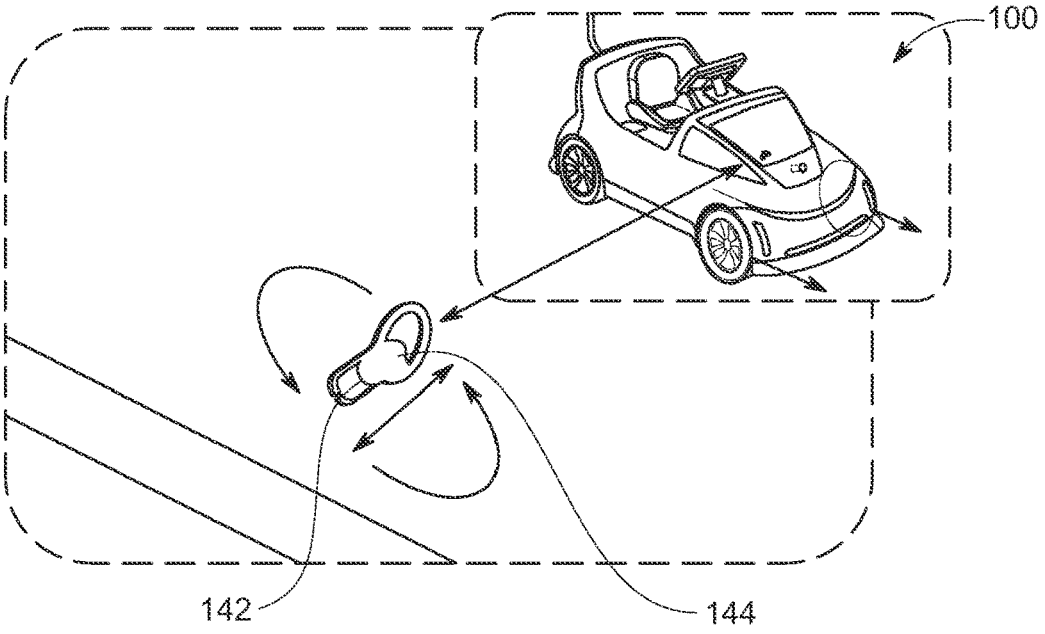
FIG. 4 is an enlarged view of a portion of the ride on vehicle depicting a steering lock of the ride on vehicle, in accordance with one embodiment of the present disclosure.

Referring to FIGS. 1 to 3, the steerable wheels 132 are adapted to be steered by a steering assembly 136 in response to a rotation of a steering handle 140 of the steering assembly 136 by a child sitting inside the vehicle 100. By moving/rotating the steering handle 140 in a left and a right direction, the child may steer the vehicle 100 in a left direction and a right direction, respectively. Further, referring to FIG. 4, the steering assembly 136 includes a steering lock 142 adapted to lock the steering wheels 132 in a straight position to prevent a movement of the steering wheels 132 in the left and right direction. In an embodiment, the steering lock 142 includes a lock pin 144 adapted to move between a first position corresponding to an unlock position of the steering lock 142 and a second position corresponding to a locked position of the steering lock 142. In the unlock position, the steering wheels 132 move in the left and the right direction in response to the rotation of the steering handle 140, while in the locked position, the movement of the steering wheels 132 in the left and the right direction from the straight position (shown in FIG. 4) is prevented even if the steering handle 140 is rotated. Accordingly, the steering lock 142 selectively disables or enables a steering of at least one steering wheel 132 of the plurality of wheels 130 in response to a rotation of the steering handle 140. The lock pin 144 is moved between the first position and the second position by displacing and/or rotating the lock pin 144 to displace the steering lock 142 between the unlock position and the locked position, respectively. In an embodiment, before moving the lock pin 144 to the second position, the steering wheels 132 are positioned/arranged in the straight position (as shown in FIG.) by operating the steering handle 140. Thereafter, the lock pin 144 is displaced to the second position from the first position to lock the steering wheels 132 in the straight position.

Further, again referring to FIGS. 2 and 3, the vehicle 100 includes two accelerator pedals, a first accelerator pedal 146 and a second accelerator pedal 148, mounted on the steering handle 140. The first accelerator pedal 146, when pressed by a user, enables a rotation of the drive wheels 134, i.e., rear wheels 134, to propel the vehicle 100 in a forward direction, while the second accelerator pedal 148, when pressed by a user, enables a rotation of the drive wheels 134 to propel the vehicle 100 in a rearward direction to facilitate a reversing of the vehicle 100. Accelerator pedals 146, 148 are released to slow down and eventually stop the movement of the vehicle 100. It may be appreciated that acceleration and speed of the vehicle in the forward direction and the reverse direction corresponds to a value of the displacement of each of the pedals 146, 148 from their respective free positions. Additionally, or optionally, the vehicle 100 may include a horn actuator 150 that may be mounted on the steering handle 100. The horn actuator 150, upon pressed by a user, causes an actuation of a horn (not shown) of the vehicle 100. Moreover, the vehicle may include at least one cup holder, two cup holders 154 arranged/defined at two sides of the seat 106 to enable a positioning of cups or bottles.

Figure 6:
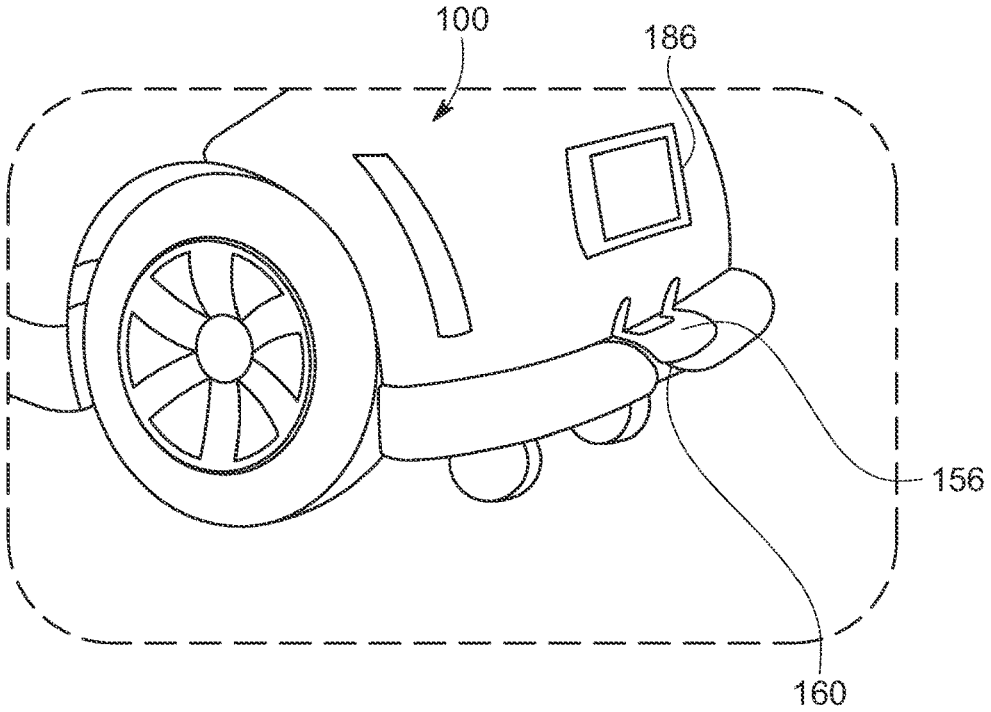
FIG. 6 is an enlarged view of a bottom portion of the rear of the ride on vehicle depicting a lever, in accordance with one embodiment of the present disclosure.

In addition, referring to FIGS. 2 and 6, the vehicle 100 may include a lever 156, for example, a foot pedal 160, to prevent the rear wheels 134 driving the vehicle 100 from propelling forwards or backwards in response to the actuation of the first accelerator pedal 146 and the second accelerator pedal 146, respectively. The lever 156 is adapted to move between a first position and a second position and may be depressed in a downward direction to move to the second position from the first position, by the caretaker when the caretaker wants to take control of the vehicle 100, or where the child may be too young to press the accelerator pedals 146, 148 for actuating the rear wheels 134. Once moved to the second position, the lever 156 remains in the second position until the caretaker moves the lever 156 to the first position. In an embodiment, the lever 156 is moved upwardly to arrange/position the lever 156 back to the first position from the second position. In one embodiment, upon displacement/positioning of the lever 156 to the second position, an output shaft of the electric motor 162 (shown in FIGS. 1 and 2) of the vehicle 100 is disengaged from the rear wheels 134, thereby preventing a transfer of rotation of the output shaft to the rear wheels 134. Accordingly, to engage the rear wheels 134 with the output shaft, the lever 156 is displaced to the first position by moving the lever 156 upwardly. In an embodiment, the vehicle 100 may include a coupling (not shown) that couples the output shaft to the rear wheels 134, and the lever 156 is adapted to control the coupling to engage and disengage the output shaft from the rear wheels 134. In some embodiments, the rear wheels 134 are lifted from the ground upon positioning of the lever 156 at the second position. Accordingly, the rear wheels 134 spin when the accelerator pedals 146, 148 are pressed without propelling the vehicle 100 in the forward or rearward direction. The propelling of the vehicle 100 through the electric motor 162 is enabled when the lever is arranged in the first position, and the propelling of the vehicle 100 through the electric motor 162 is disabled when the lever is arranged at the second position. In this manner, the caretake may move the vehicle 100 manually by pushing or pulling the vehicle through the handlebar 114 in the second position of the lever 156.

Moreover, referring back to FIGS. 1 and 2, the vehicle 100 may include a safety switch 164 to enable a user to stop the vehicle 100 and cease all electrical functions of the vehicle 100. In the embodiment, the safety switch 164 selectively enables or disables a supply of electric power to the electric motor 162 and other electrical components of the vehicle 100. In an embodiment, the safety switch 164 may be a push pull button 166 adapted to be displaced between a depressed position (shown in FIG. 1) and a reset position. To stop the vehicle 100 in an emergency condition, a caretake may displace the safety switch 164 to the depressed position from the reset position by pushing the safety switch 164 towards the vehicle 100. To reset the safety switch 164, i.e., to restore the electric supply to the electric motor 162 and other systems of the vehicle 100, the safety switch 164 is moved to the reset position by pulling the safety switch 164 towards the user. Although, the safety switch 164 is contemplated as the push pull button 166, it may be envisioned that any other type of switch that may be moved between two positions is also possible.

In an embodiment, the safety switch 164 may include an indicator 168 (as shown in FIG. 1), for example, a color marking, to indicate a user a position of the safety switch 164. It may be appreciated that the indicator 168 is visible to user when the safety switch 164 is arranged/positioned at the reset position, indicating to the user that vehicle 100 may be moved by operating the accelerator pedals 146, 148, and electrical supply is available to all the systems of the vehicle 100, while in the depressed position, the indicator 168 is invisible to the user. In an embodiment, the safety switch 164 is a first safety switch 170 (shown in FIG. 1) disposed at a front of the vehicle 100. Alternatively, the safety switch 164 may be a second safety switch 172 (best shown in FIG. 2) positioned/arranged at a rear of the vehicle 100. As shown, the second safety switch 172 is mounted/arranged at the handlebar 114 of the rod structure 110. In some embodiments, the vehicle 100 may include both safety switches 170, 172 with identical functionality. In such a case, the electric supply to the electric motor 162 and other electric components may be restored when both the safety switches 170, 172 are arranged at the reset positions. Accordingly, the vehicle 100 may be stopped by moving/displacing any one of the two safety switches 170, 172 to the second position. However, the vehicle 100 having either the first safety switch 170 or the second safety switch 172 are also encompassed within the present disclosure.

Figure 5:
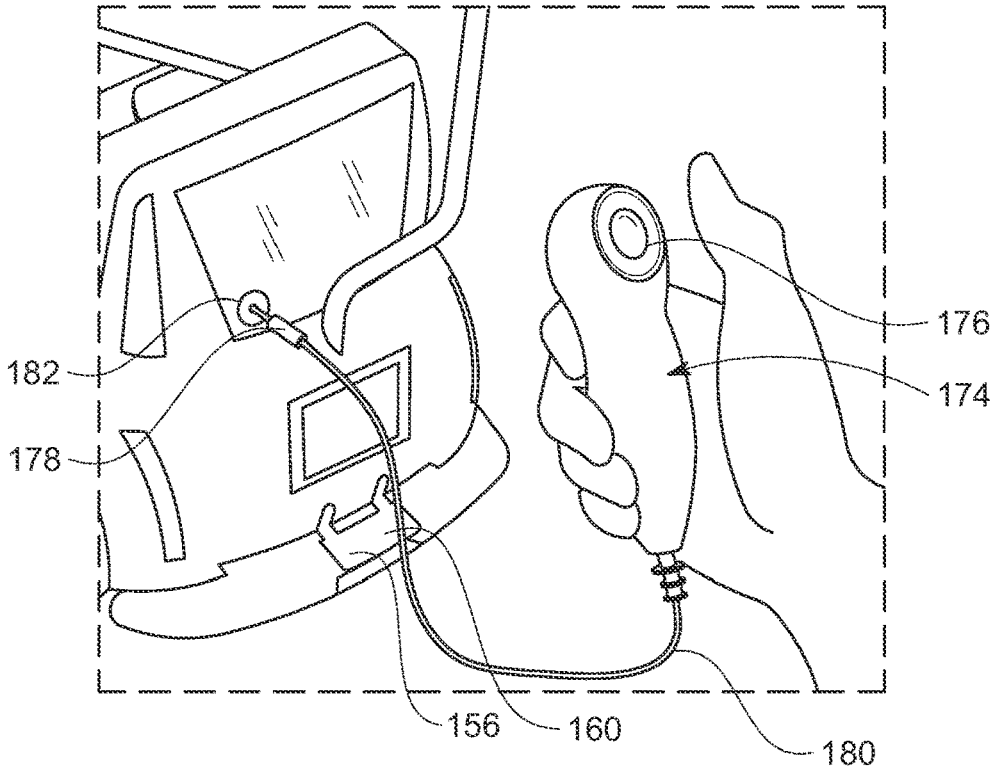
FIG. 5 is an enlarged view of a rear of the ride on vehicle having a tether connector engaged to a port of the ride on vehicle, in accordance with one embodiment of the present disclosure.

In some embodiments, as shown in FIG. 5, the vehicle 100 may include a tether connector 174 for activating or deactivating the vehicle. The activation of the vehicle 100 refers to making the vehicle 100 maneuverable through the electric motor 162, and the deactivation of the vehicle 100 refers to rendering the vehicle 100 non-maneuverable via the use of the electric motor 162. As shown, the tether connector 174 includes a switch 176 and a pin 178 connected to the switch via a communication cable 180. Further, the vehicle 100 may include a port 182 defined at a rear of the body 102 in which the pin 178 is inserted to couple the tether connector 174 with an electric control of the vehicle 100. The tether connector 174 may be unplugged from the port 182 by removing the pin 178 from the port 182. For deactivating the vehicle, the pin 178 is inserted inside the port 182, and the switch 176 is moved to an off position that corresponds to the deactivation of the vehicle 100. For activating the vehicle 100, the switch 176 is moved to an on position with the pin 178 being inserted inside the port 182. In an embodiment, the port 182 may be a USB port and the pin 178 may be USB plug.

Figure 7:
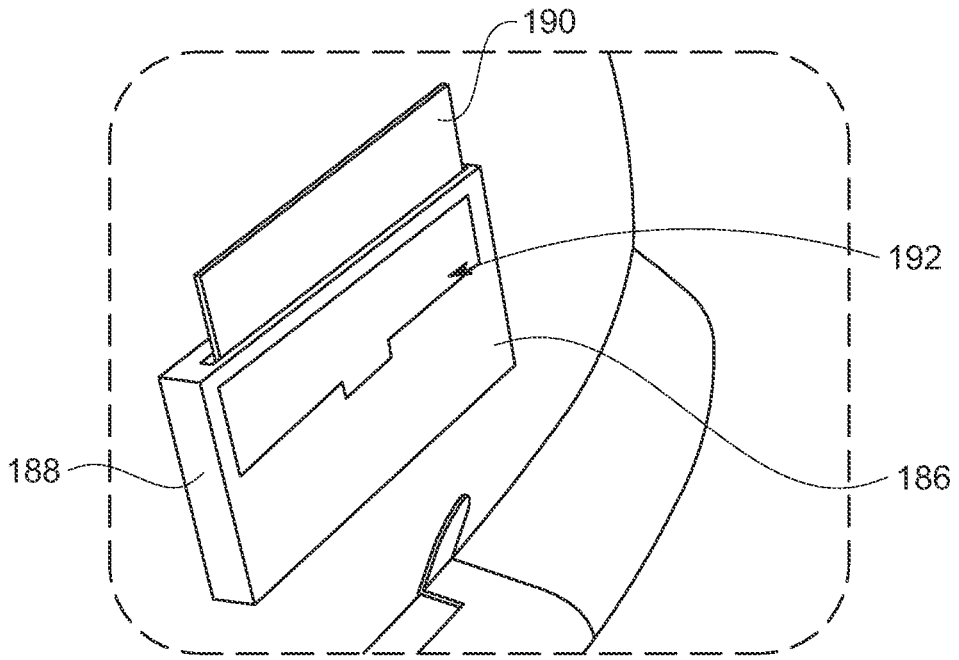
FIG. 7 is an enlarged view of a portion of the rear of the ride on vehicle depicting a license plate holder, in accordance with one embodiment of the present disclosure.
Figure 8:
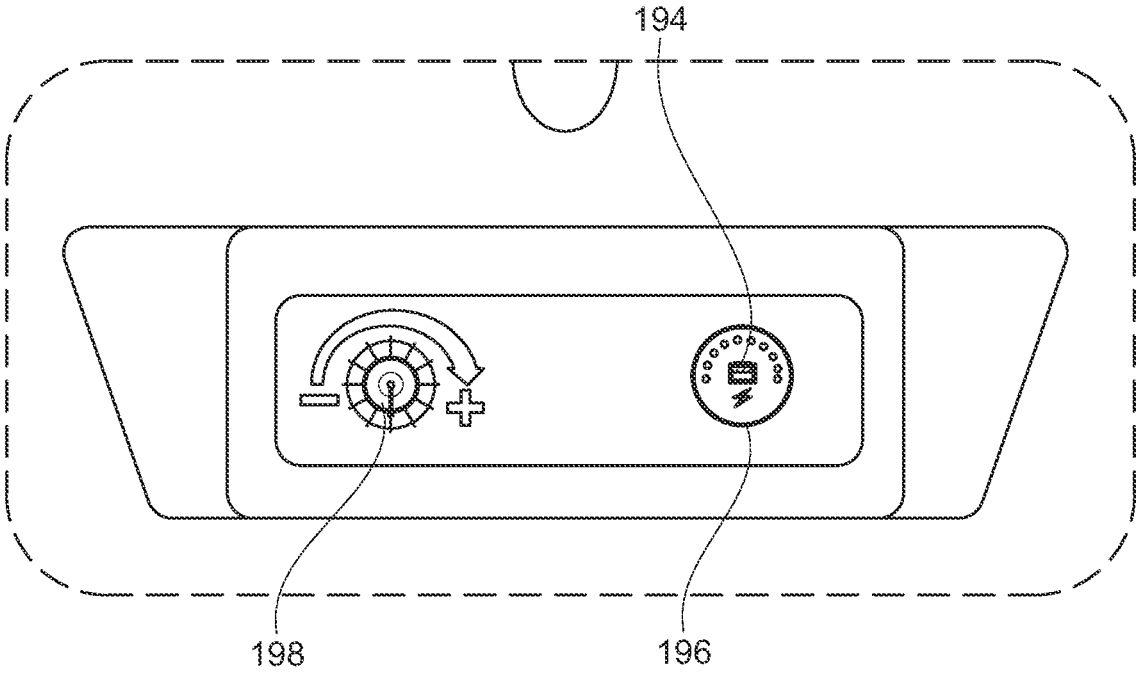
FIG. 8 is an enlarged view of a portion of the rear of the ride on vehicle with the license plate holder and depicting a speed control knob and a charging port of the ride on vehicle, in accordance with one embodiment of the present disclosure.

Further, referring to FIG. 7, the vehicle 100 includes a license plate holder 186 arranged at a rear side of the vehicle 100. The license plate holder 186 is a tray 188 having two side rails to hold a license plate 190 and a front opening 192 through which the license plate 188 is visible from an outside. In an embodiment, the license plate holder 186 is removably or movably mounted to the body 102 and may be moved or removed to access a charging port 194, a charge display 196, and a speed control knob 198 (shown in FIG. 8) covered behind the license plate holder 186. The charge display 196 is adapted to display a remaining power and/or charge of the battery 124 of the vehicle 100, while the charging port 194 enables a connection of a battery charger (not shown) to the battery 124 of the vehicle 100 for recharging the battery 124. In some embodiments, the speed control knob 198 facilitates the user to select a maximum speed of the vehicle 100. The user may set or select the maximum speed of the vehicle 100 by moving/rotating the knob 198 to one of a plurality of positions of the knob 198. Although, the speed control knob 198, the charging port 194, and the charge display 196 are contemplated to be arranged behind the license plate holder 186, it may be appreciated that the speed control knob 198, the charging port 194, and the charge display 196 may be positioned at any suitable location. Also, it may be appreciated that the positions of the speed control knob 198, the charging port 194 are selected such that the speed control knob 198 and the charging port 194 are difficult to access by the children or remain hidden from the children.

The foregoing description of embodiments and examples has been presented for purposes of illustration and description. It is not intended to be exhaustive or to limit the invention to the forms described. Numerous modifications are possible in light of the above teachings. Some of those modifications have been discussed and others will be understood by those skilled in the art. The embodiments were chosen and described in order to best illustrate certain principles and various embodiments as are suited to the particular use contemplated. The scope of the invention is, of course, not limited to the examples or embodiments set forth herein, but may be employed in any number of applications and equivalent devices by those of ordinary skill in the art. Rather it is hereby intended the scope of the invention be defined by the claims appended hereto.

What is claimed is:

1. A ride on vehicle comprising:

a vehicle body supported on a plurality of wheels;

an electric motor powered by a battery and operatively coupled to at least one drive wheel of the plurality of wheels to propel the vehicle;

a rod structure arranged at a rear of the vehicle and coupled to the vehicle body, wherein the rod structure is adapted to hold medical equipment; and a lever adapted to be displaced between a first position and a second position to selectively enable or disable a propelling of the vehicle through the electric motor, wherein in the first position, the vehicle is configured to be propelled by operating the electric motor, and in the second position, the propelling of the vehicle through the electric motor is disabled;

a steering lock adapted to be moved to a locked position and an unlock position, wherein in the locked position, at least one steering wheel is locked in a straight position and a steering of the at least steering wheel is disabled in response to a rotation of the steering handle, and in the unlock position, the at least one steering wheel is moved in response to the rotation of the steering handle.

2. The ride on vehicle of claim 1, comprising at least one accelerator pedal adapted to move the vehicle in a forward direction or a rearward direction.

3. The ride on vehicle of claim 1, wherein in the first position of the lever, the electric motor is operatively coupled to the at least one drive wheel, and in the second position of the lever, the electric motor is disengaged from the at least one drive wheel.

4. The ride on vehicle of claim 1, comprising a safety switch to selectively enable or disable a supply of an electric power to the electric motor.

5. The ride on vehicle of claim 4, wherein the safety switch is adapted to be displaced between a depressed position and a reset position, wherein the safety switch is moved to:

the depressed position to disable the supply of the electric power to the electric motor, and reset position to restore the supply of the electric power to the electric motor.

6. The ride on vehicle of claim 1, comprising a steering handle to steer the at least one steering wheel of the plurality of wheels.

7. The ride on vehicle of claim 1, comprising a speed control knob adapted to be displaced between a plurality of positions to select a maximum speed of the vehicle.

8. A ride on vehicle comprising:

a vehicle body supported on a plurality of wheels;

an electric motor powered by a battery and operatively coupled to at least one drive wheel of the plurality of wheels to propel the vehicle;

a rod structure arranged at a rear of the vehicle and coupled to the vehicle body, wherein the rod structure is adapted to hold medical equipment;

a lever adapted to be displaced between a first position and a second position to selectively enable or disable a propelling of the vehicle through the electric motor; and a steering lock adapted to be moved to a locked position and an unlock position to selectively disable or enable a steering of at least one steering wheel of the plurality of wheels in response to a rotation of a steering handle;

in the locked position, the at least one steering wheel is locked in a straight position and a steering of the at least steering wheel is disabled in response to a rotation of the steering handle, and in the unlock position, the at least one steering wheel is moved in response to the rotation of the steering handle.

9. The ride on vehicle of claim 8, wherein in the first position of the lever, the vehicle is configured to be propelled by operating the electric motor, and in the second position of the lever, the propelling of the vehicle through the electric motor is disabled.

10. The ride on vehicle of claim 9, wherein in the first position of the lever, the electric motor is operatively coupled to the at least one drive wheel, and in the second position of the lever, the electric motor is disengaged from the at least one drive wheel.

11. The ride on vehicle of claim 8, comprising a safety switch to selectively enable or disable a supply of an electric power to the electric motor.

12. The ride on vehicle of claim 11, wherein the safety switch is adapted to be displaced between a depressed position and a reset position, wherein the safety switch is displaced to:

the depressed position to disable the supply of the electric power to the electric motor, and the reset position to restore the supply of the electric power to the electric motor.

13. The ride on vehicle of claim 8, comprising a speed control knob adapted to be displaced between a plurality of positions to select a maximum speed of the vehicle.

14. A ride on vehicle comprising:

a vehicle body supported on a plurality of wheels;

an electric motor powered by a battery and operatively coupled to at least one drive wheel of the plurality of wheels to propel the vehicle;

a rod structure arranged at a rear of the vehicle and coupled to the vehicle body, wherein the rod structure is adapted to hold medical equipment;

a lever adapted to be displaced between a first position and a second position to selectively enable or disable a propelling of the vehicle through the electric motor;

a steering lock adapted to be moved to a locked position and an unlock position to selectively disable or enable a steering of at least one steering wheel of the plurality of wheels in response to a rotation of a steering handle; and in the locked position, the at least one steering wheel is locked in a straight position and a steering of the at least steering wheel is disabled in response to a rotation of the steering handle, and in the unlock position, the at least one steering wheel is moved in response to the rotation of the steering handle;

a speed control knob adapted to be displaced between a plurality of positions to select a maximum speed of the vehicle.

15. The ride on vehicle of claim 14, wherein in the first position of the lever, the vehicle is configured to be propelled by operating the electric motor, and in the second position of the lever, the propelling of the vehicle through the electric motor is disabled.

16. The ride on vehicle of claim 15, wherein in the first position of the lever, the electric motor is operatively coupled to the at least one drive wheel, and in the second position of the lever, the electric motor is disengaged from the at least one drive wheel.

17. The ride on vehicle of claim 14, comprising a safety switch adapted to be displaced between a depressed position and a reset position to selectively enable or disable a supply of an electric power to the electric motor, wherein the safety switch is displaced to:

the depressed position to disable the supply of the electric power to the electric motor, and the reset position to restore the supply of the electric power to the electric motor.

* * * * *